US005197798A

United States Patent [19]

Tickner

[11] Patent Number: 5,197,798

[45] Date of Patent: Mar. 30, 1993

[54] LIGHTING APPARATUS

[75] Inventor: Jerold A. Tickner, Scottsdale, Ariz.

[73] Assignee: Sportlite, Inc., Phoenix, Ariz.

[21] Appl. No.: 863,094

[22] Filed: Apr. 3, 1992

[51] Int. Cl.[5] ..... F21S 5/00

[52] U.S. Cl. ..... 362/235; 362/216; 362/260; 362/221; 362/405

[58] Field of Search ..... 362/235, 216, 260, 251, 362/226, 405, 404, 221

[56] References Cited

U.S. PATENT DOCUMENTS

| | | | |
|---|---|---|---|
| 3,735,329 | 5/1973 | Funabashi et al. | 362/405 |
| 4,520,436 | 5/1985 | McNair | 362/366 |
| 4,595,969 | 6/2986 | McNair | 362/217 |
| 4,704,664 | 11/1987 | McNair | 362/225 |
| 4,802,073 | 1/1989 | Plumly | 362/221 |
| 4,922,393 | 5/1990 | McNair | 362/225 |

FOREIGN PATENT DOCUMENTS

| | | | |
|---|---|---|---|
| 945777 | 7/1956 | Fed. Rep. of Germany | 362/216 |
| 1085180 | 1/1955 | France | 362/216 |
| 878534 | 10/1961 | United Kingdom | 362/235 |

*Primary Examiner*—Ira S. Lazarus
*Assistant Examiner*—L. Heyman
*Attorney, Agent, or Firm*—LaValle D. Ptak

[57] ABSTRACT

A conversion replacement apparatus for HID screw-in mercury vapor, metal halide or high or low pressure sodium lamps utilizes the reflector typically employed with such lamps. The HID lamp is removed from the reflector. A fluorescent lamp support frame then is attached to the base end of the inside of the reflector to extend to a point substantially one-fourth to one-half of the distance between the base end and the light-emitting end of the reflector. The support includes a plurality of extensions for holding the bases of compact fluorescent lamps arranged in a general star configuration around the center line of the reflector. The extensions are bent at an angle to cause the compact fluorescent lamps to follow the outwardly-flared inside surface of the reflector. Ballasts for the lamps are located in a housing attached to the base end of the reflector. Additional controls are provided for selectively supplying power to different ones of the ballasts for the fluorescent lamps to effectively provide "dimming" of the overall light output from the fixture.

16 Claims, 2 Drawing Sheets

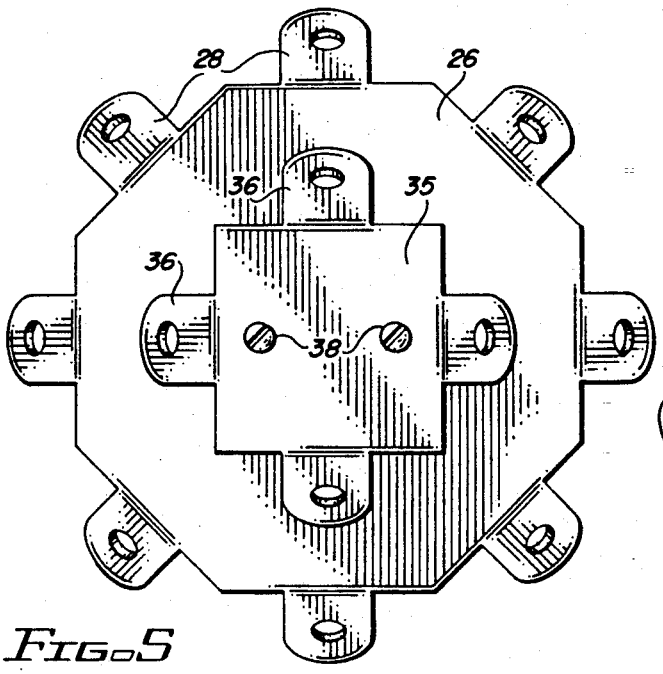
FIG. 5
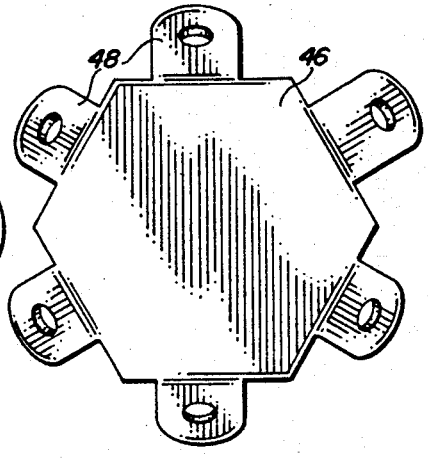
FIG. 6
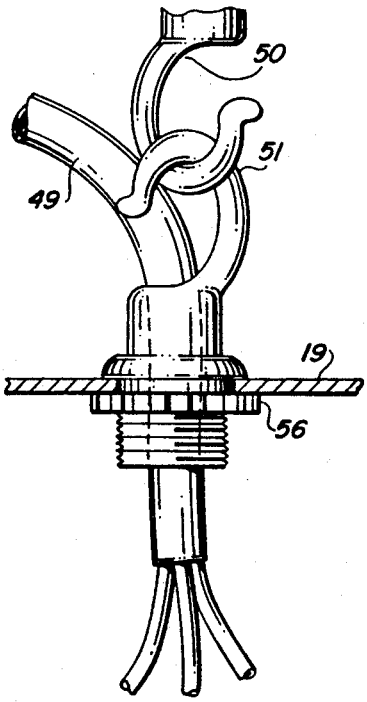
FIG. 8
FIG. 7
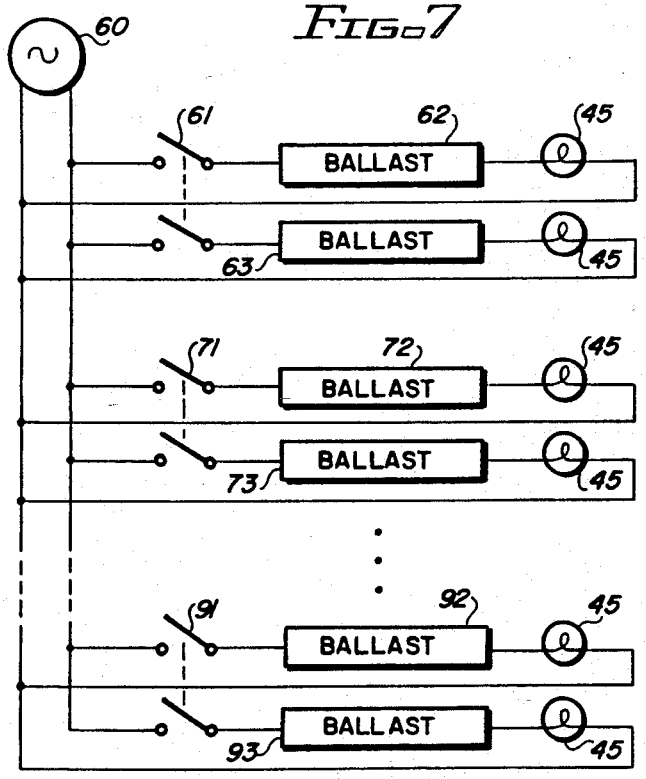

LIGHTING APPARATUS

BACKGROUND

High intensity discharge (HID) lamp fixtures are widely used to provide lighting in warehouses, airplane hangars, and other commercial buildings. Typically, fixtures using such lamps use mercury vapor, metal halide, and high or low pressure sodium lamps, depending upon the particular application and the lighting characteristics desired. Such lamps generally are high wattage (500 or 1000 Watts, for example); so that in the buildings in which they are used, significant energy consumption takes place.

For the purpose of maximizing the downward light output from such high wattage lamps, flared, generally bell-shaped reflectors have been designed to fit over the base of the bulb, which then is itself, in at least some of these applications, forms the support for the reflector, which generally is made of polished aluminum or similar lightweight material. The lamp extends through the base end of the reflector; and the light-emitting end is either open or covered with a translucent lens to disperse the light emanating from the lamp, and to provide a more attractive appearance.

The coverage or area of illumination of a typical reflector for an HID lamp of this type generally is approximately 1.6 (that is, it is 1.6 times the height from the floor to the light-emitting opening of the fixture). The light typically is projected in a circle; so that the spacing of the lamp fixtures is selected in accordance with this formula to provide the desired amount of overlap, if any, needed for any particular application.

A primary problem with HID lamps, of any of the above types, is that the high wattage results in significant energy consumption, which, in turn, translates into high utility bills. Fluorescent lamp fixtures typically are low wattage fixtures; but for providing the desired levels of illumination in warehouses, airplane hangars and similar high-ceilinged buildings, a large number of fluorescent light fixtures must be employed to produce the desired lumens of light on the floor of the building in which they are used. The large number of fixtures required results in significantly increased initial installation cost over the fixtures required for HID lamps, typically spaced greater distances apart in a comparative installation. In addition, many applications indicate that standard fluorescent lamp fixtures cannot produce the necessary lumens of light at the floor or work surface of warehouses and the like.

Generally, commercial ceiling lamps for fluorescent light fixtures employ elongated fluorescent tubes, usually having a length of four or eight feet. These tubes then are placed in appropriate luminaires oriented parallel to the floor or ground to produce the desired illumination. Installation and replacement of fluorescent tubes, particularly eight foot tubes, is somewhat difficult simply because of the length of the tubes involved.

Compact fluorescent tubes have been designed in a generally "folded-over" configuration, which attach to a light fixture at one end. Three patents disclosing ceiling light fixtures for recessed lamp reflectors, and which use compact fluorescent tubes, are the patents to McNair Nos. 4,520,436; 4,704,664; and 4,922,393. These patents disclose the use of a pair of compact fluorescent lamps, mounted in a generally crossed configuration inside a dome-shaped reflector, to produce a light output which is comparable to that of an incandescent bulb in a reflector having a similar diameter light-emitting end. The reflector, itself, is designed with openings through it, in which the bases of the lamps are mounted (on the upper outside of the reflector). Provisions also are made for attaching the ballasts for the lamps to the outside of the reflector. The reflector then is placed in a recessed housing in the ceiling to accommodate all of the lamp sockets and ballasts in a space between the reflector and the end of the housing.

In the devices shown in all of these patents, the housing itself has a threaded lamp base on it to supply operating current to the ballasts and the lamps. The conventional screw-in threaded base then may be inserted into a normal incandescent lamp socket; so that the entire housing is suspended from the socket. These fixtures are designed to replace incandescent lamps in recessed ceiling fixtures of relatively low wattage (typically replacing a 60 to 100 Watt incandescent lamp). Lower power consumption results; and the lumen output, using crossed pairs of compact fluorescent lamps, is approximately equivalent to the incandescent lamp replaced. In addition to reduced power consumption, the compact fluorescent lamps typically have a life several times greater than the life of incandescent lamps.

It is desirable to provide a lighting apparatus which may be directly substituted for high-wattage HID lamp fixtures, or, alternatively, which may be directly substituted for HID lamps as a direct replacement, which provides the advantages of reduced power consumption, which is relatively inexpensive and which produces a lumen output comparable to the high-wattage HID lamps being replaced.

SUMMARY OF THE INVENTION

Accordingly, it is an object of this invention to provide an improved lighting apparatus.

It is another object of this invention to provide an improved fluorescent lighting apparatus.

It is an additional object of this invention to provide an improved compact fluorescent lighting apparatus capable of substitution for HID lamp apparatus.

It is a further object of this invention to provide an improved lighting apparatus using compact fluorescent lamps arranged in a multiple-lamp array within a reflector of the type normally used for high-wattage HID lamps for producing improved coverage, reduced energy consumption, and substantially equivalent lumen output.

It is yet another object of this invention to provide a multiple-lamp array of fluorescent lamps with selective operation of the lamps for effect stepped dimming of the light from the array.

In accordance with a preferred embodiment of the invention, a lighting apparatus includes a reflector which has a base end and a light-emitting end. The reflector is of a symmetrical shape about a line extending from the center of the base end to the center of the light-emitting end. A lamp support structure is located within the reflector, and is attached to the reflector to support a plurality of compact fluorescent lamps within the reflector between the base and the light-emitting end. Electric power is supplied to the lamps located within the reflector on the lamp support means. In a more specific embodiment of the invention, the lamp support is attached to the base end of the reflector; and electric power is supplied to the lamps through direct wiring or a screw-in base, which is chosen to match the base of a standard HID lamp or incandescent bulb being replaced by the lighting apparatus.

BRIEF DESCRIPTION OF THE DRAWING

FIG. 5 is an end view of the portion shown in FIG. 4;

FIG. 6 is an alternative end view of a variation of the structure shown in FIG. 4;

FIG. 7 is a schematic diagram of an electrical operating circuit for the embodiment shown in FIGS. 2 through 5; and FIG. 8 is a detail of an alternative to the portion of the embodiment shown in FIG. 2.

DETAILED DESCRIPTION

Figure 1:
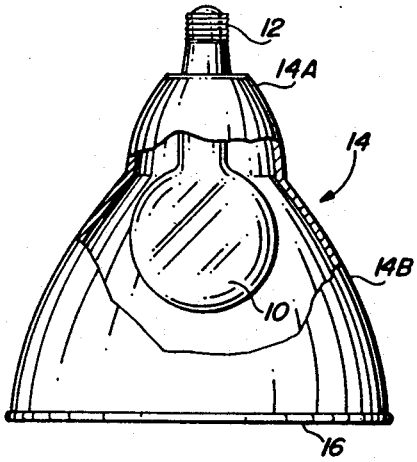
FIG. 1 (PRIOR ART)
FIG. 1 is a partially cut-away view of a lamp fixture of the prior art.

Reference now should be made to the drawing, in which the same reference numbers are made throughout the different figures to designate the same or similar components. FIG. 1 is a partially cut-away illustration of a typical prior art HID lamp fixture of the type widely used in large commercial buildings, such as warehouses, airplane hangars and the like. The fixture employs a high-wattage (250, 400 or 1000 Watt) HID lamp 10, which may be mercury vapor, metal halide, incandescent, or high or low pressure sodium. The lamp 10 has a threaded base 12, which is screwed into an appropriate mating receptacle mounted in the ceiling of the building Because of the high wattage of the lamp 10, the screw-in base 12 usually is of larger diameter than the common household light bulbs with lower wattages in the range of 25 to 150 Watts.

The base of the bulb 10 extends through a circular opening in the base of a generally bell-shaped reflector 14; so that the reflector 14 is suspended by and held in place by the lamp 10, which extends through the opening in the reflector. The reflector itself has two primary portions. An upper portion 14A, which is relatively narrow, extends downwardly alongside the neck of the bulb 10. The lower portion 14B is an outwardly flared reflector portion, which increases in diameter from the base of the upper portion 14A to a light-emitting end 16. Typically, a translucent lens is placed in the light-emitting end 16 to improve the dispersement of light from the bulb 10 within the reflector 14.

Figure 2:
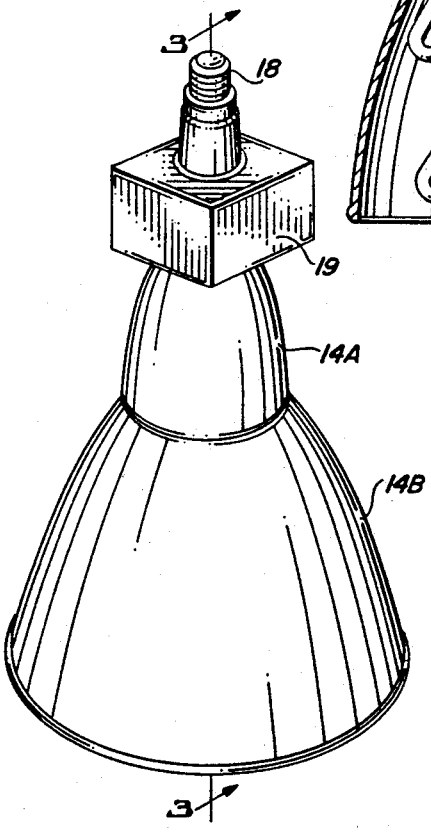
FIG. 2 is a perspective view of a preferred embodiment of the invention.

FIGS. 2, 3, 4 and 5 illustrate a preferred embodiment of the invention for use in replacing the high-wattage HID bulb 10 with an array of compact fluorescent lamps consuming significantly less energy, while at the same time producing equivalent or nearly equivalent lumen output from the reflector 14. As illustrated in FIG. 2, this is accomplished in part by mounting the base end of the reflector portion 14A on a housing 19. This housing has an electrical input to it provided through a mogul screw-in base 18, which matches the size of the base 12 of the lamp being replaced. Each of the several fluorescent lamps, which are located within the lower bell-shaped portion of the housing 14B, is operated by ballasts located within the housing 19. Each ballast, in turn, controls one or two lamps per ballast in a standard manner.

Figure 3:
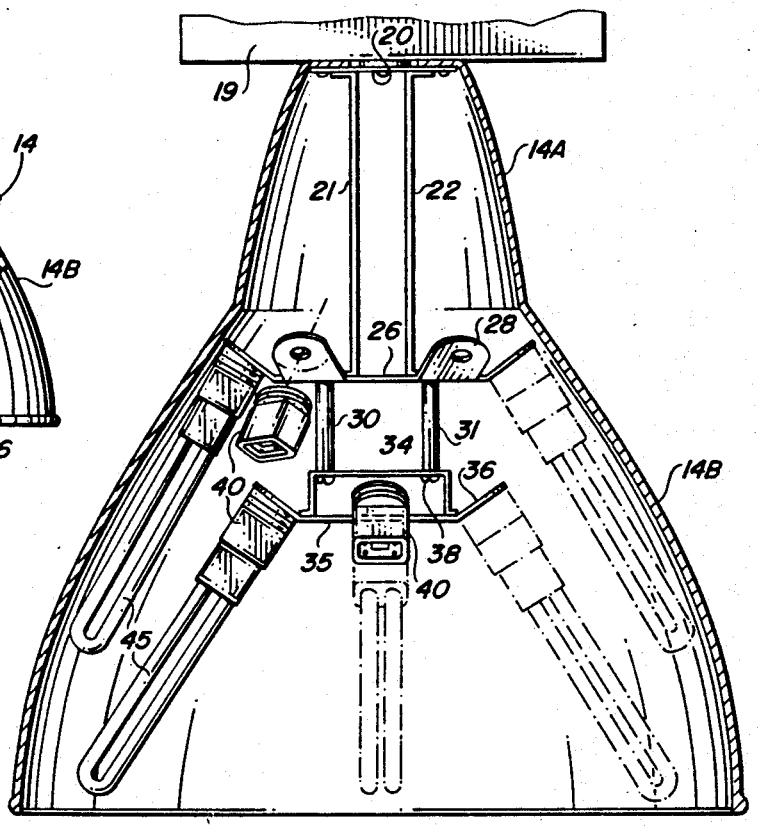
FIG. 3 is cross-sectional view taken along the line 3—3 of FIG. 2.

FIG. 3 illustrates a cross-sectional view of the modification which has been made to adapt the reflector 14 to use a multiple lamp fluorescent array substituted for the HID lamp 10. This is accomplished by building a lamp support in the portion 14A of the reflector on a base 20, which is secured to the base end of the reflector 14A by means of suitable fasteners, such as screws or bolts, or by means of welding or brazing. The fasteners, which secure the base 20 to the base end of the portion 14A of the reflector 14, also may be extended through the base 20, the base end of the reflector 14 into the housing 19 to secure all of the parts together, if desired. A circular opening (not shown) is provided in the center of the base 20 to accommodate wires from the ballasts located within the housing 19 to be interconnected with the various sockets 40 for the compact fluorescent lamps 45, which are plugged into these sockets. The wires are not shown in FIG. 3 to avoid unnecessary cluttering of the drawing.

The lamp support further includes a pair of elongated "U-shaped" rectangular legs 21 and 22, which are riveted to or otherwise attached at one end to the base member 20, and extend inside the portion 14A of the reflector 14 to support a lamp mounting plate 26 on the opposite end. The lamp mounting plate 26 also is attached to the legs 21 and 22 by means of rivets, brazing or any other suitable means to suspend the plate 26 in the center of the reflector 14B approximately one-third the length of the reflector from the base end to the light exiting end 16. This is illustrated most clearly in FIG. 3.

Figure 4:
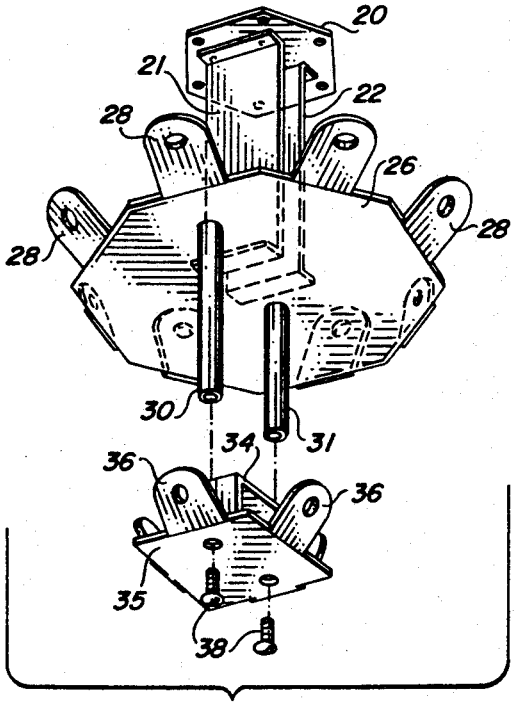
FIG. 4 is a partially exploded view of a detail of the embodiment shown in FIG. 3.

As illustrated in FIGS. 3, 4 and 5, the plate 26 is octagonal in shape, and includes, on each of its outer edges, an extension tab 28 onto which a conventional socket 40 is attached for receiving a commercially available push-in compact fluorescent lamp 45. As illustrated most clearly in FIG. 3, the tabs 28 are bent upwardly (as viewed in FIG. 3) approximately 20° to 30° from the plane of the plate 26 to cause the lamps 45 to extend along a line generally following the curvature of the inside of the reflector portion 14B. The relative positions, which are occupied by at least some of these lamps, are shown in FIG. 3. It is to be understood that eight lamps 45 are connected in a star-like array around the periphery of the octagonal plate 26.

As further illustrated in FIGS. 3, 4 and 5, additional lamps 45 are mounted within the circle of lamps carried on the plate 26. These additional lamps are mounted on a supplementary, smaller plate 35 supported by a pair of posts 30 and 31 attached to a U-shaped bracket 34 on the underside of the plate 35, as illustrated most clearly in FIGS. 3 and 4. Suitable screws or bolts 38 are used to attach the bracket 34 to the ends of the posts 30 and 31. These screws or bolts 38 pass through enlarged holes in the plate 35, so that they can be used to secure the bracket 34 to the ends of the posts 30 and 31.

As illustrated in FIGS. 3, 4 and 5, the plate 35 is shown as a square plate having lamp mounting extensions 36 on each of the four edges. These extensions 36 also are bent upwardly (as viewed in FIG. 3) approximately 20° to 30° to cause the lamps 45, attached to sockets 40 on each of the extensions 36, to assume the configuration illustrated in FIG. 3.

Each of the lamps 45 is a standard compact fluorescent lamp, and typically consumes 27 Watts of power. Such a fluorescent lamp generally is considered equivalent to a 100 Watt incandescent or HID lamp; so that the equivalent wattage output of the twelve lamps 45, shown in the array of the embodiment illustrated in FIGS. 3, 4 and 5, is 1200 Watts. When this array is used to replace a 1000 Watt HID bulb 10, the actual wattage consumed by the twelve lamps is 324 Watts (12 × 27). This amounts to approximately a two-thirds saving in the energy consumption of the fixture which has been retrofitted as illustrated in FIGS. 3, 4 and 5. To improve the lumen output of the fixture, the surfaces of the plates 26 and 35 may be made of reflective material similar to the polished aluminum interior reflective surface of the portions 14A and 14B of the reflector 14.

In addition to producing an equivalent lumen light output for significantly less energy, the lamp fixture or lamp apparatus of FIGS. 3, 4 and 5 also produces an increased coverage or circle of light in the region beneath the reflector over that which is obtained from the same reflector using an HID bulb 12. As mentioned earlier, the typical coverage for the prior art fixture of FIG. 1 is approximately 1.6 (that is, the circle of light on the floor is approximately 1.6 times the distance from the floor to the lighting-emitting end 16 of the reflector 14). By replacing the HID bulb 10 with the array shown in FIGS. 3, 4 and 5, the coverage from the reflector 14 increases to 2.0 to 2.4 (that is, the circle of light beneath the reflector is from 2.0 to 2.4 times the distance between the floor and the light-emitting end 16 of the fixture). For new installations, this means the fixtures can be spaced farther apart to obtain substantially the same lumen intensity on the surface below the fixtures. This results in decreased installation costs (fewer fixtures are required), and even greater improved savings in the energy consumption (since the overall number of fixtures has been reduced, as well as the wattage consumed by each fixture).

Another significant advantage, which can be obtained with a multiple lamp fixture of the type shown in FIGS. 3, 4 and 5, is that by operating each lamp with an individual ballast or by operating pairs of lamps on opposite sides of each of the star-like arrays on the plates 26 and 35, with a different ballast for each pair, the capability for built-in "dimming" occurs. Reference should be made to FIG. 7 for the manner in which this effected. FIG. 7 is a diagrammatic representation of the electrical circuit which supplies operating power to each of the lamps 45 in the array located within the reflector 14. As illustrated in FIG. 7, alternating current power from a suitable source 60 (as provided to the mogul screw-in base 18, or direct wired) is supplied to switch pairs 61, 71 and 91 through individual ballasts 62, 63, 72, 73 and 92, 93 for each of the lamps 45. Only six lamps and three sets of switches 61, 71 and 91 are illustrated in FIG. 7. It is to be understood, however, that pairs of lamps 45 operated by pairs of ganged switches, such as the switches 61, 71 and 91, may be provided for all twelve of the lamps of the array in FIGS. 3, 4 and 5. The number of lamps shown in FIG. 7, however, is reduced to avoid unnecessary cluttering, since the operation of each pair of lamps is the same as for the three pairs which are shown in FIG. 7.

When all of the switches 61, 71 and 91 are closed, all of the lamps are provided with operating power through their respective ballasts, and, thus, are illuminated. Selective dimming, however, is effected by opening one or more switch pairs to disconnect power from the ballasts driving the lamps associated with the particular opened switch pair, such as 61, 71 or 91. If one of the switch pairs is opened, then ten of the twelve lamps within the array of FIGS. 3, 4 and 5 are illuminated. If three sets of the switch pairs, such as 61, 71 and 91 are opened, half of the lamp pairs are turned off, and half of the lamp pairs 45 remain illuminated, thereby reducing the light output of the fixture by fifty percent. This also reduces the energy consumption by fifty percent. Obviously, the opening of more or less numbers of switch pairs 61, 71 and 91 (and others not shown) can be utilized to provide other "dimming" percentages in accordance with the operating requirements of the system with which the lighting apparatus of FIGS. 3, 4 and 5 is used.

It also should be noted that although FIG. 7 indicates an individual ballast 62, 63, 72, 73 or 92, 93 for each individual lamp 45, a single ballast could be used to drive two lamps; and the system operation for effecting the selective dimming then would require a switching off of only a single ballast for each two lamps. Otherwise, the operation is identical to that described in conjunction with the arrangement shown in FIG. 7.

Control of the operation of the switch pairs 61, 71 and 91 may be effected in any suitable manner. For example, low voltage relay switches could be enclosed within the housing 19, or at a remote on/off switch location, for effecting the desired operation of the switches. Digitally-encoded electronic switching also could be used from a remote or central location, as desired. The manner of effecting the overall dimming, however, is the same; and the technique used to operate the switches 61, 71 and 91 may be any suitable technique currently known, in accordance with the desires of the system installer and/or user. It is important to note that when dimming is effected in the manner described in conjunction with circuit of FIG. 7, there is no illumination flicker, since the lamps 45 which remain illuminated are powered with full power in the normal manner of powering such lamps. It also is possible, however, to provide conventional internal ballast dimming in addition to the switched dimming described above, if desired. Other features, such as uninterruptable power supply, emergency backup capability also may be employed with the system if desired.

FIG. 8 illustrates an alternative variation to provide power to the ballasts within the housing 19 to replace the screw-in base 18, which is illustrated in FIG. 2. For new installations in particular, it is not necessary to provide a screw-in base; and the system may be hardwired from an electrical box, with the wiring 49 then passing through a suitable knock-out in the housing 19. The wires passing through a suitable knock-out then are connected to the ballast in a conventional manner. For maximum flexibility, the wiring through the knock-out may be passed through a hollow center hook 51 attached to the knock-out by means of a securing nut 56, as illustrated. The hook 51 then is used to hang the housing 19 and the remainder of the fixture attached to it from the ceiling by means of a mating hook 50, illustrated in FIG. 8. In all other respects, the lighting apparatus or fixture, modified as shown in FIG. 8, operates in the manner described above for the embodiment of FIGS. 2, 3, 4 and 5.

FIG. 6 illustrates an alternative embodiment for replacing the plates 26 and 35 with a single smaller plate 46. The configuration with a single plate 46 (illustrated as a hexagonal plate) may be used for smaller reflectors 14, or for reflectors 14 which do not need to produce the quantity of light produced by the embodiment described in conjunction with FIGS. 3, 4 and 5. As illustrated in FIG. 6, six lamp-base holding tabs 48 are provided. If such a configuration is used in place of the plates 26 and 35 of FIG. 3, the arrangement of the six lamps 45, which are attached to the bases 40 on the extensions 48, is similar to that for the lamps shown attached to the bases 26 and 35 illustrated in FIG. 3. The tabs 48 are bent upwardly at approximately a 20° to 30° angle to produce the lighting spread and lumen output desired. In all other respects, a fixture which uses the star-like configuration of FIG. 6 in place of the one shown in FIG. 5, operates in the manner described above for the embodiment of FIGS. 3, 4 and 5.

Various changes and modifications will occur to those skilled in the art, without departing from the true scope of this invention. The ballast location, for example, may be at a remote location rather than in a housing 19 attached to the end of the portion 14A of the reflector 14. Because the section 14A of the reflector 14 does not have any lamp parts in it, it also is possible to locate the ballasts in this portion; so that no requirement for a separate ballast housing 19 on the outside of the reflector is necessary. To accomplish this, the legs 21 and 22 may be arranged to connect the ballasts to them in any suitable manner, with the plate 20 then having the screw-in mogul 18 or the variation of FIG. 8 attached to it for mounting the fixture. The manner of location of the ballasts is not significant; and the ballast location does not affect the multiple lamp lighting arrangement. Other changes will occur to those skilled in the art, without departing from the true scope of the invention as defined in the appended claims.

I claim:

1. Lighting apparatus including in combination:

reflector means having a base end and a light-emitting end;

lamp support means located within said reflector means, and attached to the base end of said reflector means and extending toward the light-emitting end thereof for supporting a plurality of compact fluorescent lamps within said reflector means between the base end and the light-emitting end thereof, said lamps being substantially equally angularly displaced around a center line extending from the center of the base to the center of the light-emitting end of said reflector means;

said lamp support means comprising a central support member located between approximately one-fourth and one-half of the distance from the base end of said reflector to the light-emitting end thereof, and further including at least two lamp support extensions on said central support member on opposite sides thereof for causing compact fluorescent lamps supported thereby to extend outwardly at an angle along a line generally parallel to the surface of said reflector means; and means for supplying operating electric power to lamps supported by said lamp support means.

2. The combination according to claim 1 wherein said reflector means has circular cross sections in planes perpendicular to said center line.

3. The combination according to claim 2 wherein said cross sections increase in diameter form the base end of said reflector means to the light-emitting end thereof.

4. The combination according to claim 3 wherein said extensions comprise bendable tabs, and said central support member comprises a substantially flat plate mounted in a plane perpendicular to said center line, with said tabs on the periphery thereof and bent toward the base end of said reflector means.

5. The combination according to claim 4 further including a supplemental lamp support means attached to said central support member, and spaced therefrom toward the light-emitting end of said reflector means for supporting an additional plurality of compact fluorescent lamps thereon within said reflector means.

6. The combination according to claim 4 wherein said reflector means comprises a ceiling reflector of the type used for mercury vapor, halide, incandescent, and high or low pressure sodium lamps, in which said lamp support means is attached to the base end thereof; and wherein said means for supplying operating electric power includes a mogul screw-in base, which matches the base of a lamp being replaced by said lighting apparatus.

7. The combination according to claim 4 wherein said means for supplying operating electric power further includes a plurality of ballasts for supplying power to corresponding lamps supported by said lamp support means.

8. The combination according to claim 7 further including means for selectively applying power to different numbers of lamps supported by said support means.

9. The combination according to claim 1 wherein said reflector means comprises a ceiling reflector of the type used for mercury vapor, halide, incandescent, and high or low pressure sodium lamps, in which said lamp support means is attached to the base end thereof; and wherein said means for supplying operating electric power includes a mogul screw-in base, which matches the base of a lamp being replaced by said lighting apparatus.

10. The combination according to claim 9 wherein said reflector means has circular cross sections in planes perpendicular to said center line.

11. The combination according to claim 10 wherein said circular cross sections increase in diameter from the base end of said reflector means to the light-emitting end thereof.

12. Lighting apparatus including in combination:

reflector means having a base end and a light-emitting end and having a center line extending from the center of the base end to the center of the light-emitting end thereof;

lamp support means located within said reflector means, and attached to the base end of said reflector means for supporting a plurality of compact fluorescent lamps substantially equally angularly displaced about said center line within said reflector means between the base end and the light-emitting end thereof, said lamp support means comprising a central support member in the form of a substantially flat plate mounted in a plane perpendicular to said center line located between approximately one-fourth and one-half of the distance from the base end of said reflector to the light-emitting end thereof, and further including at least two lamp support extensions on the periphery of said flat plate on opposite sides thereof and bent toward the base end of said reflector means for causing compact fluorescent lamps supported thereby to extend outwardly at an angle toward said reflector means;

means for supplying operating electric power to lamps supported by said lamp support means.

13. The combination according to claim 12 wherein said means for supplying operating electric power further includes a plurality of ballasts for supplying power to corresponding lamps supported by said lamp support means.

14. The combination according to claim 13 further including means for selectively applying power to different numbers of lamps supported by said support means.

15. The combination according to claim 12 wherein said lamp support means comprises a central support member located between approximately one-fourth and one-half of the distance from the base end of said reflector to the light-emitting end thereof, and further including at least two lamp support extensions on said central support member on opposite sides thereof for causing compact fluorescent lamps supported thereby to extend outwardly at an angle toward said reflector means.

16. The combination according to claim 15 further including a supplemental lamp support means attached to said central support member, and spaced therefrom toward the light-emitting end of said reflector means for supporting an additional plurality of compact fluorescent lamps thereon within said reflector means.

* * * * *